US005420929A

United States Patent [19]

Geddes et al.

[11] Patent Number: 5,420,929

[45] Date of Patent: May 30, 1995

[54] SIGNAL PROCESSOR FOR SOUND IMAGE ENHANCEMENT

[75] Inventors: Earl R. Geddes, Livonia; J. William Whikehart, Novi, both of Mich.

[73] Assignee: Ford Motor Company, Dearborn, Mich.

[21] Appl. No.: 888,087

[22] Filed: May 26, 1992

[51] Int. Cl.[6] ..... H04R 5/00

[52] U.S. Cl. ..... 381/1; 381/22

[58] Field of Search ..... 381/1, 25, 22, 27, 26, 381/86

[56] References Cited

U.S. PATENT DOCUMENTS

| | | | |
|---|---|---|---|
| 4,060,696 | 11/1977 | Iwahara et al. | 381/26 |
| 4,192,969 | 3/1980 | Iwahara | 381/1 |
| 4,219,696 | 8/1980 | Kogure et al. | 179/1 |
| 4,309,570 | 1/1982 | Carver | 179/1 |
| 4,329,544 | 5/1982 | Yamada | 179/1 |
| 4,388,494 | 6/1983 | Schöne et al. | 381/1 |
| 4,394,536 | 7/1983 | Shima et al. | 179/1 |
| 4,495,637 | 1/1985 | Bruney | 381/1 |
| 4,603,429 | 7/1986 | Carver | 381/1 |
| 4,622,689 | 11/1986 | Horbrough | 381/27 |
| 4,868,878 | 9/1989 | Kunugi et al. | 381/1 |
| 4,980,914 | 12/1990 | Kunugi et al. | 381/1 |
| 4,980,915 | 12/1990 | Ishikawa | 381/27 |

FOREIGN PATENT DOCUMENTS

| | | | |
|---|---|---|---|
| 8401257 | 3/1984 | WIPO | 381/1 |

*Primary Examiner*—Curtis Kuntz
*Assistant Examiner*—Ping W. Le
*Attorney, Agent, or Firm*—Roger L. May; Mark L. Mollon

[57] ABSTRACT

A signal processor for sound image enhancement of stereophonic signals provides fluctuating coherence between the left channel and right channel outputs by crossfeeding a high pass portion of the left channel to the right output and a like portion of the right channel to the left output. Preferably, the crossfeed path includes a high pass filter to eliminate crossfeeding of lower frequency range components which are often reproduced monaurally in prerecorded materials. The filtering is compensated for by a shelving filter introduced in the respective channel input to boost the power of the lower frequency components to be added with the crossfed signal to produce the channel output. In the preferred embodiment, an automatic gain control varies the gain of the crossfeed in accordance with the stereo content in the input channels. In addition, the gain control includes a control for user variation of the amount of coherence to be generated at the output. Furthermore, the present invention also provides a stereo detector circuit.

29 Claims, 3 Drawing Sheets

LEFT IN
RIGHT IN
LEFT OUT
RIGHT OUT
Hm(f,g)
Hd(f,g)

DELAY
LHPF
RHPF

DEADZONE WIDTH
MAX. VALUE
LIMIT
DEAD ZONE
CURVE
SENSITIVITY (0 TO 1)
RD/RS'
PRE-DIVIDE
ABS
DECIMATE
GA
GB

FIG 6
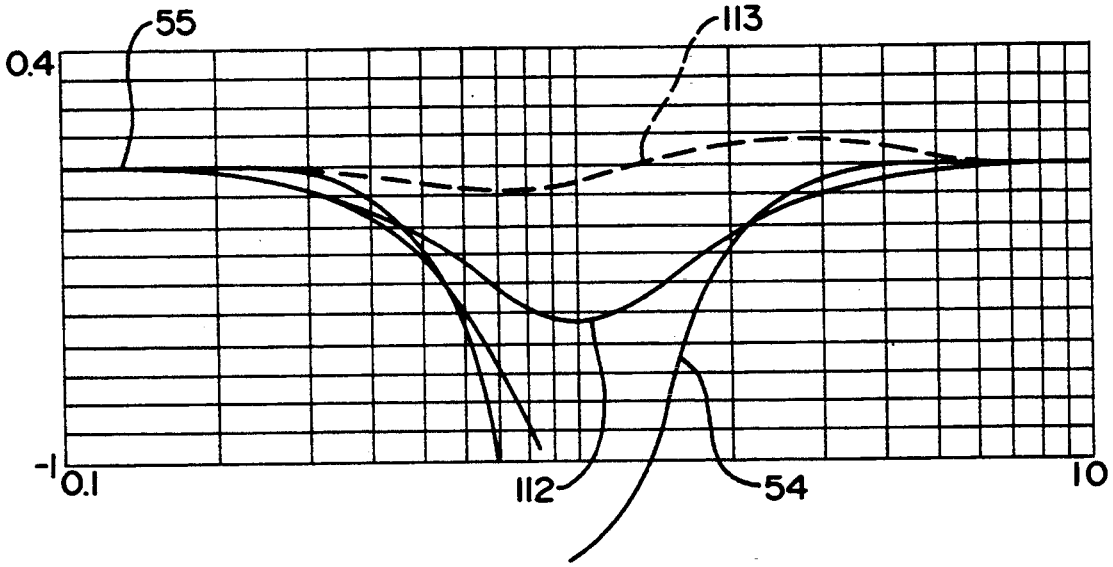
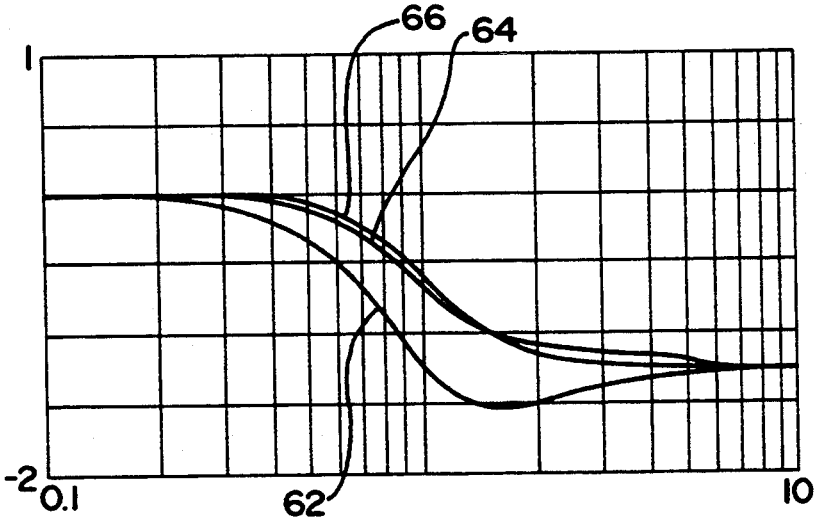
FIG 7

SIGNAL PROCESSOR FOR SOUND IMAGE ENHANCEMENT

TECHNICAL FIELD

The present invention relates generally to stereophonic reproduction systems, and more particularly to such systems in which the stereo signals are processed to enhance the sound image pattern in a sound area serviced by speakers mounted at discrete locations.

BACKGROUND ART

In the art of sound reproduction systems, it is well known that the location of transducers, often referred to as loudspeakers, has a substantial affect upon sound reproduction of stereophonic signals. Accordingly, speakers are preferably arranged in order to produce psychoacoustically pleasurable sounds to the area occupied by the listeners. However, particularly in motor vehicles, the number and position of the speakers is often dictated by other packaging considerations and cannot be arranged for the sole purpose of providing maximum listening pleasure to the vehicle occupants. Accordingly, there have been several developments to process the signals to be emitted from the speakers in order to adjust the audio reproduction image of a stereophonic signals.

Several attempts have been made to generate signals that simulate a relocation of the speakers as if they had been spread further apart or located in a different direction from the listening area. U.S. Pat. No. 4,329,544 to Yamada discloses a sound reproduction system attempting to audibly simulate a wider distance between the speakers. A transfer function equalizes sound pressures from a signal representative of a third speaker location and the conventional output emitted from stereo speakers. The system also includes a delay circuit in one channel to compensate for the difference in distances between the listener and each of the speakers, and also includes a reverberation circuit. U.S. Pat. No. 4,394,536 also discloses an apparatus for acoustic spreading and reverberation effects for reproduced sound and the effects can be adjusted by the user.

U.S. Pat. No. 4,868,878 to Kunugi et al. discloses a sound field correcting system in which the transfer function adjusts a level in delay of the signal to compensate for the distance between the travel of direct and reflective sound waves to a listening point. U.S. Pat. No. 4,980,914 issued from a continuation-in-part application of U.S. Pat. No. 4,868,878 and discloses the additional feature that high pass or low pass filters may be used as desired at appropriate points of the system.

U.S. Pat. No. 4,980,915 to Ishikawa discloses an integrated circuit switch for use with a system including a center input signal as well as left and right input signals.

U.S. Pat. No. 4,495,637 discloses a method and apparatus for enhancing psycho-acoustic imagery by asymetrically crossfeeding left and right signal inputs. The asymmetry is designed to complement the listener's brain processing of perceived acoustic signals due to naturally occurring left or right half brain dominance of the listener. The system employs out of phase crossfeed without filtering or delays.

U.S. Pat. No. 4,388,494 to Schone et al. discloses a stereophonic reproduction system using the dummy head recording process and a headphone reproduction process with filtering and crossfeeding of the channels.

Like U.S. Patents to Yamada and Kunugi et al., U.S. Pat. No. 4,219,696 to Kogure et al. reproduces sound from two loudspeakers located in front of the listener to generate relocalized sound in a manner that simulates sound reproduction sources to the rear of the listener. The apparatus includes transfer functions canceling sound in the direct path and imposing a time difference between sound waves applied to the left and right ears of the listener. Similarly, U.S. Patent No. 4,192,969 to Iwahara discloses a stereophonic sound reproduction system simulating an expanded stage by crossfeed paths between the channels with a first transfer function representative of ratio of the crossfeed transfer function to the direct transfer function corresponding to a hypothetical sound location with respect to the listener's ears, and a second transfer function corresponding to the ratio of crossfeed transfer function to direct transfer function corresponding to the actual sound direction.

TECHNICAL PROBLEM RESOLVED

The present invention is distinguishable from the above-identified disclosures by processing each channel input signal in a crossfeed path having a transfer function circuit for frequency weighting the coherence of the sound signals emitted from the left and right channel output speakers. A processed crossfeed signal is added to the opposite channel signal to produce each channel output. The result is that the psycho-acoustic image is narrower than the speaker separation although signals at selected frequencies continue to maintain their original stereo separation. Accordingly, the present invention avoids the hole-in-the-center effect perceived when speakers are spaced far apart. As a result, the present invention provides a psycho-acoustic impression that the speakers are actually located closer to the speaker positions of a more ideal listening environment where sound sources are forward of and within a predetermined angular alignment with the listening position. For example, an ideal environment might be considered one in which speakers are aligned toward a listening position and positioned about 40° off the central axis between the speakers.

Preferably, the transfer function circuit includes a signal processor for imposing repeated phase reversal continuously throughout a predetermined band of signal frequencies, preferably implemented by delay. The transfer function H is a function of the frequency and preferably, also a function of the crossfeed gain G. The processor controls the crossfeed of mono signals to avoid annoying frequency coloration should mono signals be present. The low-frequency content of input stereo signals are typically mono (left and right channels are coherent). Furthermore, broadcast speech and music pieces or passages can be mono, and this mono content can be over all frequencies. Mono signals should not be crossfed, since the resulting output signals will consist of signals added to a delayed version of themselves. Such adding causes substantial frequency coloration. In particular, a frequency component of an input signal having a period of 2T, where T is the crossfeed delay time, would disappear completely from the output since it is added to itself 180° out of phase. In a similar manner, a component with period T would add to itself in phase, producing twice as much output for that component. Therefore, the processor must remove low-frequency signal content in the crossfed signals.

For signals with mono content over substantially all frequencies, removing on the low-frequency content is not sufficient. Therefore, the system of the present invention includes a gain control circuit that turns off the imaging effect when the signal is mono. The gain control of the preferred embodiment includes user operable control over the amount of imaging effect and automatic control depending upon the amount of mono content in the input signal, preferably after low frequency content has been removed. Accordingly, a gain control circuit according to the present invention includes a stereo signal detection circuit for control of the amount of gain in the crossfeed path.

In the preferred embodiment, the crossfeed paths include high pass filters to avoid crossfeeding the low frequency signal content. Since the output of each channel is the sum of a delayed first channel input added to the opposite input signal, the image control circuit could produce an output power spectrum with increased magnitude at high frequencies. Accordingly, a shelving filter is included for each channel input line to be added to the crossfeed signal from the other channel, so that a predetermined amount of boost at the low frequencies compensates for the added output at the higher frequencies. In the preferred embodiment, a branch line with a low pass filtered version of the input signal is added to the channel input line and the crossfeed line to obtain the flat net output response.

While the gain of the crossfed signal controls the amount of the imaging effect, the gain adjustment circuit should also adjust the gains of the direct input and branch paths to keep the output power spectrum flat given a flat input spectrum.

When using a lowpass filter in a branch line to obtain a shelving filter response, and with the direct, branch, and crossfeed gains adjusted properly, the output power spectrum is flat except for possibly near the lowpass and highpass filters' cutoff frequencies, where ripple can occur. This ripple can be significant for some applications. As will be described later, it is computationally desirable to make the lowpass and highpass filter cutoff frequencies the same. In this situation, a 0.5 dB dip occurs at the cutoff frequency due to the phase relationship of the filters in this region.

To compensate for this unadjusted effect, one approach is to add an all-pass filter in the direct path that has the same delay response as the low pass filter in the branch line, but with a flat magnitude response. A second approach is to add a phase-equalizer (an all-pass filter) after the low pass filter in the branch path to make the net response in the branch path phase linear so that the same amount of delay is imposed at all frequencies. The net delay of the branch path would also be added to the direct path. A still further approach which is an approximate solution and the simplest is to add a fixed delay to the direct path since the delay in the low frequency content in the branch path signal can be approximated by a constant delay. The amount of constant delay added to the direct path should also be added to the delay in the crossfeed path to keep the net delay between these paths the same.

As a result, the present invention provides stereophonic reproduction of stereo channel signals with a narrower psycho-acoustic image than the spacing between the speakers. The system acoustically simulates substantially closer presence of the program material to the listener by fluctuating the coherence of the channel signal outputs without adjusting the physical location of the speakers. As a result, this is especially useful in motor vehicle passenger compartments where positions of speakers are often fixed by considerations unrelated to the acoustic environment within the vehicle.

The present invention also provides automatic control of the imaging effect by controlling the amount of crossfeed gain according to the amount of stereo content in the left and right signals. The power spectrum response of the system is preferably maintained at a substantially constant level regardless of the amount of crossfeed.

BRIEF DESCRIPTION OF THE DRAWINGS

The present invention will be more clearly understood by reference to the following detailed description of a preferred embodiment when read in conjunction with the accompanying drawing in which like reference characters refer to like parts throughout the views and in which:

FIGS. 2A–2B is a graphical representation of the input channel signals delivered to and the output channel signals produced by the circuit shown in FIG. 1;

FIGS. 3A–3B is a graphical representation of the transfer function employed in the crossfeed path 10 of the circuit shown in FIG. 1;

FIG. 6 is an enlarged graphical representation of a portion of the output signal curves shown in FIG. 2 and generated by the circuit shown in FIG. 4; and FIG. 7 is a graphical representation of the output of the shelving filter employed in the circuit of FIG. 4.

BEST MODE OF THE INVENTION

Figures 1, 4, 5:
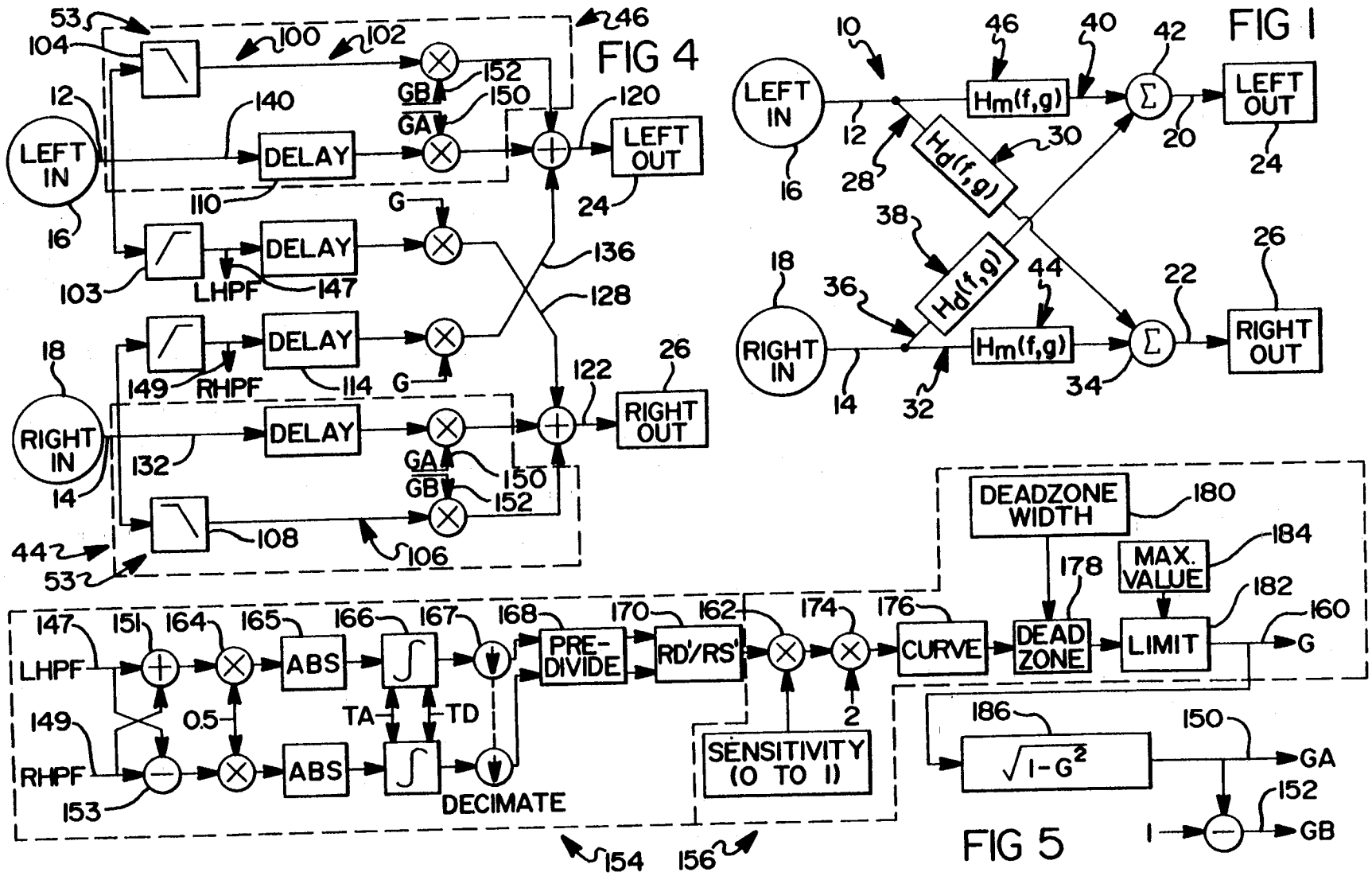
FIG. 1 is a diagrammatic view of the overall circuit configuration for sound image enhancement according to the present invention.
FIG. 4 is a diagrammatic view of a more detailed modification of the general circuit configuration shown in FIG. 1.
FIG. 5 is a diagrammatic view of a stereo detector circuit for use with the circuit shown in FIG. 4.

Referring first to FIG. 1, the stereo imaging processing circuit 10 is shown comprising a left channel input line 12 as well as a right channel input line 14 receiving signals from a left channel source 16 and a right channel source 18 as diagrammatically represented in FIG. 1. Of course, the left channel source 16 and the right channel source 18 may be parts of a single stereophonic reproduction component such as a tuner, preamp or the like. In addition, the circuit 10 generates a left channel output line 20 and a right channel output line 22 coupled to respective transducers such as speakers 24 and 26.

Still referring to FIG. 1, input line 12 is branched to a crossfeed path 28 including a transfer function 30 which is added to the right channel direct path 32 by appropriate adding circuitry 34. Similarly, the right channel input line is branched through a crossfeed path 36 including a transfer function 38 which is added to a direct path 40 from the left channel input line 12 at an appropriate adding circuit 42.

Figure 3B:
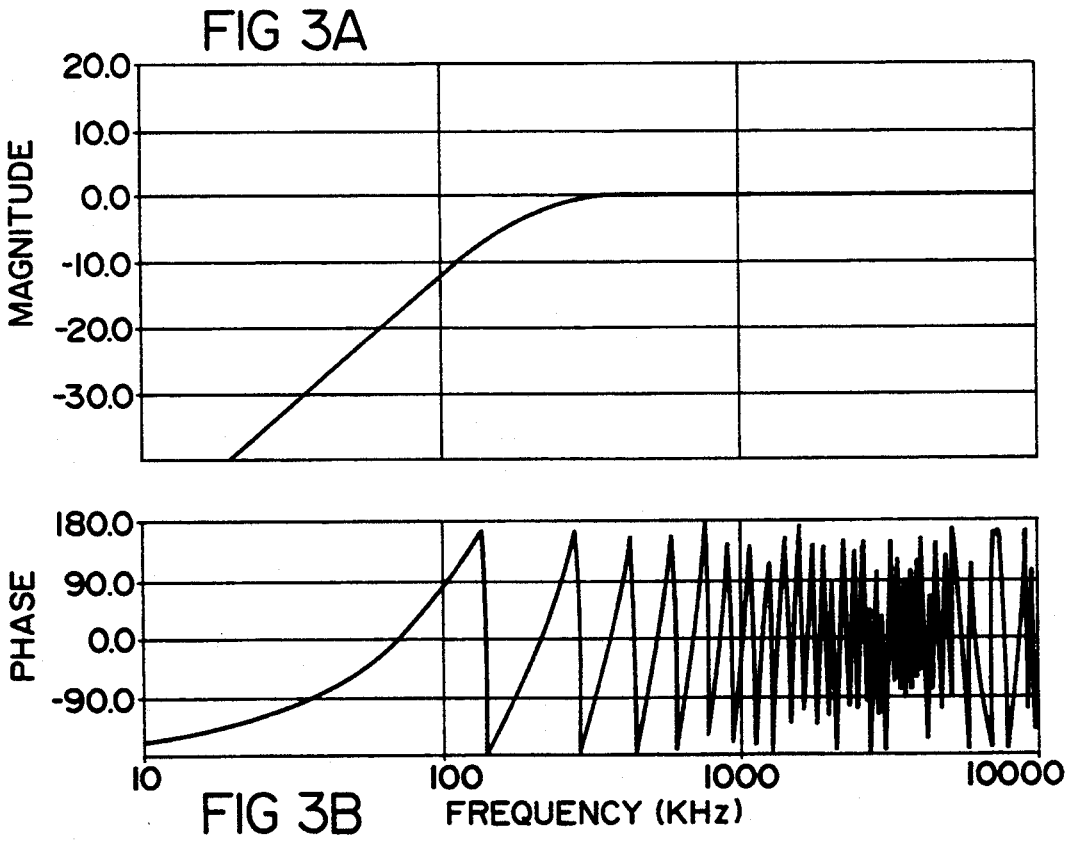

The crossfeed transfer functions 30 and 38 contain a frequency weighting circuit. The transfer function employed in the preferred embodiment is shown in FIG. 3*a* and FIG. 3*b*. The magnitude of the function, as shown in FIG. 3*a*, is at a maximum above a predetermined frequency so that the lower frequency signal components of the channel inputs are substantially attenuated by the transfer function since such frequencies often have mono content. The rapidly changing phase response in FIG. 3*b* is due to a frequency independent delay, preferably between 2 and 10 milliseconds, which is part of the crossfeed transfer function.

Figure 2B:
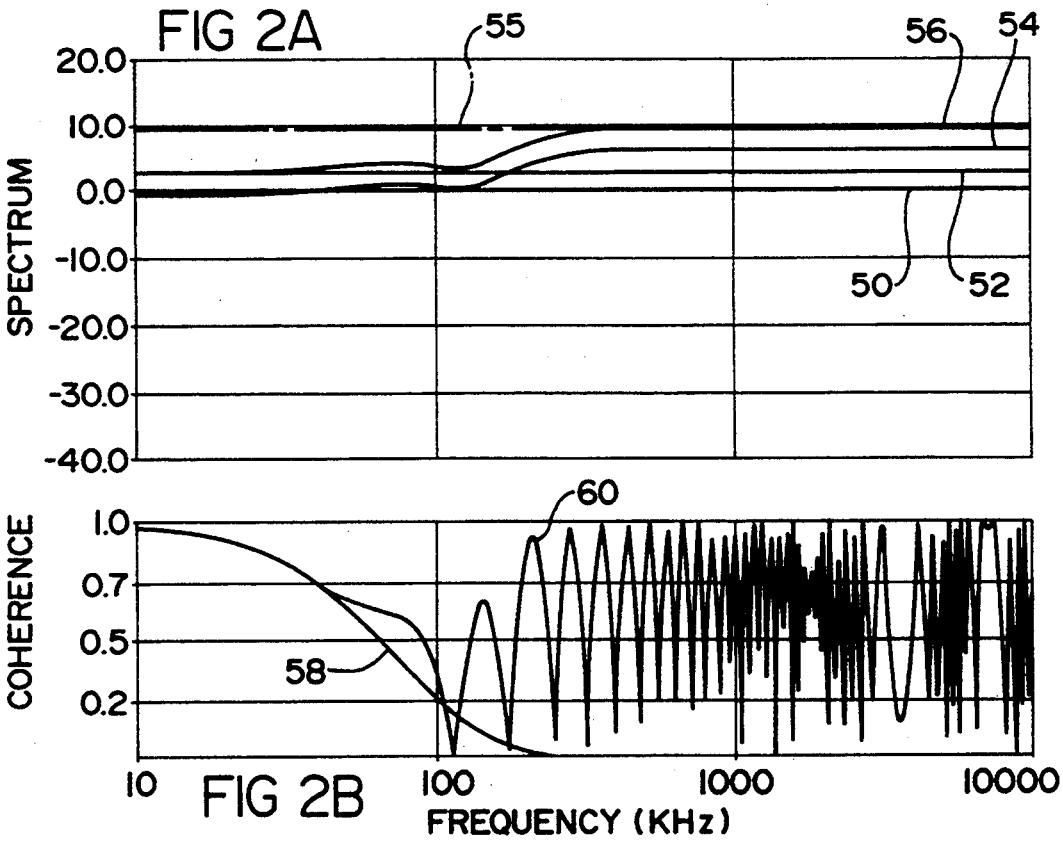

The result of this signal processing is graphically demonstrated in FIGS. 2*a* and 2*b*. In FIG. 2*a*, the plotted line 50 represents left channel and right input channel signal spectrums. Plotted line 52 indicates the sum of the signal strengths of the left and right channel. Line 54 demonstrates the output signal spectrum of each channel output line 20 and 22, while line 56 demonstrates the sum of the signal strengths transmitted at output channels 20 and 22. It is desired that for a flat and equal input spectrums, the output spectrums should be flat and equal. However, this is not the case as can be seen in 54. To make the output spectrums flat, the low-frequency part of the outputs must be boosted. A shelving filter could be used to boost the low frequency signal power output to the same level as the higher frequency components. The effect of the boost is illustrated in phantom line at 55 in FIG. 2*a*. Preferably, the gains are controlled for a net 0 db output as described in greater detail below.

In FIG. 2*b*, the coherence of the left channel and right channel input lines 12 and 14 is demonstrated at curve 58. The curve 58 demonstrates that the lowest frequency signal components are substantially mono as they are reproduced substantially equally in both channels in prerecorded material. Conversely, the higher frequency signal components maintain their separated stereo imaging. In other words, the coherence is valued closer to 0 for the signal components with higher frequencies. Graphic trace 60 demonstrates the fluctuating coherence of the output signal generated at the channel output lines 20 and 22. Thus, as a result of processing in the imaging circuit 10, the stereo separation at certain frequencies varies between 0 and 1 throughout the entire upper range of frequencies in the signals processed.

Accordingly, the output from the speakers 24 and 26 is demonstrated to be coherent at numerous frequencies through a wide band while other frequency components remain entirely right or left channel outputs. As a result, the acoustic image of the sound reproduction is perceived to be narrower than the physical distance between the left channel speaker 24 and the right channel speaker 26. Such a feature is particularly useful when the speakers are located at the outermost borders of the passenger compartment of a motor vehicle.

While the circuit described above provides the desired stereo imaging effect, the presence of mono signals in the crossfeed branches causes identical signals to be added at the adding circuits 34 and 42. This substantially changes the frequency spectrum of the resulting signal for the reason that mono signal components are added to delayed versions of themselves due to the crossfeed signal added. As previously discussed, components with various periods are attenuated or boosted depending on their periods relative to the time delay. As a result, control may be provided to avoid undesirable frequency coloration occurs that substantially effects the audio output of the program material.

Mono input cannot be avoided since the low-frequency content of most signals is mono as previously shown in FIG. 2*b*. Also, the voice content heard as normal speech on a stereo broadcast, and particular music pieces or passages are transmitted monaurally. The highpass response of the crossfeed paths prevents the substantially mono low-frequency content from being crossfed. A circuit improvement which would turn off the imaging effect when the signal is significantly mono at frequencies that pass through the high pass filters will be desirable. The switching is best accomplished by controlling the crossfeed gain in response to the amount of mono content in the signal that is crossfed. Thus, a gain control circuit with a stereo detector is illustrated in the circuit configuration shown in FIGS. 4 and 5.

As shown in FIG. 4, the imaging circuit 100 includes a shelving filter 53 in each transfer function 44 and 46 implemented by coupling a branch line to the channel input line. The left branch path 102 includes a transfer function 104 in the form of a low pass filter whose output is added to the sum of the direct input line 40 and the crossfeed path 136. The transfer function 104 in branch line 102 may be an exact complement of the high pass filter used for crossfeeding. These filters may be provided by a state-variable filter 103, as indicated diagrammatically in FIG. 4, so that the low pass and high pass functions are obtained simultaneously in an efficient signal processing manner. Similarly, the right channel input line 114 includes a branch line 106 with the transfer function 108 in the form of a low pass filter for adding to the sum of the direct line 132 and crossfeed path 128 from the left channel.

In addition, each of the three signals added at each of the channel output lines 120 and 122 must be multiplied by related gain constants in order to control the output response to obtain a flat power spectrum output. As discussed above, the gain of the crossfeed signal controls the amount of the imaging effect. The gains in each of the direct paths 140, 132 and in the branch paths 102 and 106 are correspondingly controlled to compensate for or offset the crossfeed gain and keep the spectrum flat. The gain control will be discussed in greater detail with respect to FIG. 5.

The use of the state-variable filter to obtain lowpass and highpass filters simultaneously results in the filters having the same cutoff frequencies. The addition of the lowpass filter output to the direct path, with the correct gain settings, results in the desired shelving filter spectral response, except near the cutoff frequency. Near the cutoff frequency, due to the phase relationships of the low pass filter and the direct path, an error of 0.5 dB occurs relative to the desired shelving filter response 66 in the shelving filter response as shown in 62 in FIG. 7. This in turn results in a 0.5 db error in the final output spectral response as shown at 112 in FIG. 6, and in many applications, this may be undesirable.

Any of several preferred approaches may be employed to compensate for the error. A transfer function 110 in the direct line 140 can comprise an all-pass filter that has the same delay response as the low pass filter of transfer function 104. A further approach would be to include an all-pass filter in the branch line 102 after the low pass filter to make the net response in the low pass path phase linear. The phase linear response means that all frequencies have the same amount of delay. A corresponding constant delay 110 would also be added to the direct path 140. Furthermore, similar filters would be employed in the branch and direct lines of the opposite channel.

The most preferred approach, which is chosen for its simplicity, is to approximate the delay of the low pass filter in the branch path by imposing a constant delay 110 in path 140. The use of a constant delay is justified by the fact that frequencies from 0 to about the corner frequency of the low pass filter have a generally constant delay. Appropriate selection of a predetermined delay in the direct path can reduce the ripple in the output power spectrum to as low as plus or minus 0.08 db as is illustrated in FIG. 6 at curve 113. In contrast, without any delay offered by a transfer function 110, the output power spectrum has a 0.5db dip at the corner frequency as demonstrated by curve 112 in FIG. 6. Of course, the amount of constant delay added to the direct path 140 must also be added to the crossfeed path 136 to keep the net delay between these paths the same as they are added at the adder circuit 120. Similarly, the right channel processor paths can be modified as discussed above with respect to the left channel paths, and the discussion need not be repeated in order to provide a complete disclosure. Nevertheless the shelving filter output is adjusted as shown at 64 in FIG. 7 and closely conforms with the ideal shelving filter output curve 66.

Referring now to FIG. 5, a preferred gain control mechanism with a stereo detector for automatically controlling the crossfeed gains provides two useful functions. In particular, the gain G of the crossfeed path can be automatically varied in response to the stereo content of the signals running through the left and right channel inputs. Secondly, the imaging effect can be varied as desired by the listener in order to produce the desired acoustical effect. FIG. 5 diagrammatically represents the circuit features of signal processing according to the present invention to generate the crossfeed gain G with control signal 160. In addition, the circuit generates the compensating gain GA with control signal 150 for the direct paths 140 and 132 and the compensating gain GB with control signal 152 in the branch paths 102 and 106 that maintain a flat power output spectrum by offsetting the varying crossfeed gain generated as a function of the stereo separation detected.

In the block diagram of FIG. 5, a high pass filtered signal 147 from the left-to-right crossfeed path 128 and a similar signal 149 from the crossfeed path 136 are introduced to the adder 151 and subtractor 153 as shown. The sum of and the difference between the left channel signal and the right channel signal are generated and then envelope—detected to determine their respective levels. When the signal pair is mono (coherent), the left signal level equals the right signal level and so the detected difference level is 0. When the signals are not mono (non-coherent), the detected difference level is non-zero. Thus, the detected difference level varies according to the amount of stereo content. However, the detected difference level also changes according to the absolute levels of the left and right signals.

To compensate for normal stereophonic reproduction in which the left and right signals will vary in level independent of stereo content, the detected difference is normalized. Accordingly, the detected difference is divided by the detected sum of the left and right signals as at 170 to provide a quantity representing the amount of stereo content N in the signal. The result (called N) varies from 0 for fully coherent left and right signals to 1 for fully non-coherent left and right signals.

The basic stereo detector circuit 154 of the preferred embodiment includes an additive gain reducing function 164. In addition, an absolute value detector 165 provides an output signal that is integrated at 166 with a predetermined integrator attack time constant and a predetermined integrator decay time constant, preferably in the range of one millisecond and one hundred milliseconds, respectively. The signals are then simultaneously decimated as diagrammatically shown at 167, preferably reducing the sampling rate by an 8 to 1 ratio, to reduce the number of samples which need to be used in order to calculate the difference to sum ratio. Decimation is appropriate since the integrators reduce the signal bandwidth, thus allowing a lower sample rate. Decimation reduces the computational load for the subsequent processing shown in FIG. 5. The decimated result is predivided at 168 to avoid complications under special conditions such as when the detected sum level is 0 and when the detected difference is larger than the detected sum due to the operation of the envelope detectors 165.

An additional processing section 156 for the stereo-dependent gain of the imaging circuit to assure that the amount of stereo, originally represented by the value N output from ratio 170, is multiplied by a sensitivity factor which is adjustable by a user control 162. The sensitivity control controls how much the crossfeed gain G is affected by the stereo detector. A factor of 2 at control 174 allows a multiplied net sensitivity of 0 to 2. In addition, sensitivity can also be adjusted by an arbitrary curve function 176.

In the preferred embodiment, the function 176 provides a piece wise linear curve that varies the rate of change of the signal level with respect to the amount of stereo content in the signal. A modified stereo content signal output from the curve circuit 176 is subjected to a dead zone function in order to prevent small changes in the signal level N due to noise or other inconsistencies, from modulating the crossfeed gain. An adjustable dead zone circuit 178 provides a dead zone around the current value of the modified signal representing crossfeed gain, so that the gain output of the circuit 156 changes only when large changes occur. When the input to the function circuit 178 increases or decreases more than the width of the dead zone, the gain is automatically increased or lowered. As a result, noise or distortion does not modulate the crossfeed gain affecting the right and left output signals. The dead zone circuit 178 includes a manual adjustor 180 for varying the width of the dead zone.

In addition a limit function 182 may be used to limit the value of the crossfeed gain or to turn off the imaging effect if desired. A limit adjustor 184 controls the limit imposed upon the crossfeed gain control signal before the signal is delivered to the gain controllers in the crossfeed paths 128 and 136. In addition, the compensator 186 varies the compensatory gain control signals applied to the gain controllers in the direct paths 132 and 140 as well as in the branch paths 102 and 106 to maintain a flat power output at the channel outputs 120 and 122.

As a result of the above description, it will be understood that the present invention provides a signal processor for reducing the width of the stereo image produced during stereophonic reproduction. As a result, the present invention eliminates the hole-in-the-middle response typically associated with sound reproduction systems having widely spaced speaker locations with respect to the listener position. Moreover, the automatic gain control automatically varies the amount of imaging effect in response to the amount of stereo content being delivered to the processor. Furthermore, the circuit is arranged so as to provide a flat power output response given a flat input response and it avoids frequency coloration of the sound output produced. The stereo detector circuit may also be employed for other imaging or signal functions.

Having thus described the present invention, many modifications thereto will become apparent to those skilled in the art to which it pertains without departing from the scope and spirit of the present invention as defined in the appended claims. For example, the preferred embodiment has been described in terms of the digital signal processing (DSP) preferably employed in the environment of a motor vehicle, where such processing capability for its implementation is readily available. However, it is readily apparent that other techniques and apparatus, for example, hardwired analog circuits, could be used to generate the circuits of the present invention.

We claim:

1. An apparatus for narrowing stereo imaging of stereophonic signals to be delivered to at least one pair of loudspeakers comprising:

a left channel output line coupled to a first speaker of said at least one pair;

a right channel output line coupled to a second speaker of said at least one pair;

a left channel input line;

a right channel input line;

a left-to-right crossfeed path initiating at said left channel input line, a right adder for adding said left-to-right crossfeed path to said right input line at said right channel output line;

a right-to-left crossfeed path initiating at said right channel input line;

a left adder for adding said right-to-left crossfeed path to said left channel input line at said left channel output line;

each of said crossfeed paths having a transfer function circuit for repeatedly fluctuating the phase of the respective input signal passing through the crossfeed path to vary the channel coherence of the sound signal emitted from said at least one pair of loudspeakers.

2. The invention as defined in claim 1 wherein said transfer function circuit includes a signal processor for imposing repeated phase reversal continuously along a predetermined band of frequencies.

3. The invention as defined in claim 2 wherein said signal processor includes a high pass filter.

4. The invention as defined in claim 1 wherein said transfer function circuit imposes a delay upon the signal added from each said crossfeed path and further comprising each of said left channel input line and said right channel input line including a signal delay circuit for delaying the signal added to the respective crossfeed path.

5. The invention as defined in claim 4 wherein said signal delay circuit includes means for imposing a predetermined, frequency independent delay on said signal in said respective input line.

6. The invention as defined in claim 1 and further comprising a gain control for limiting the maximum output to a flat response over the audio signal frequency range at said left channel output line and said right channel output line by limiting at least one input to each of said right adder and said left adder.

7. The invention as defined in claim 6 wherein said gain control includes means for manually adjusting the gain of each said signal added at said channel outputs.

8. The invention as defined in claim 1 wherein each said left channel input line communicates with a left branch line having a low pass filter for adding low frequency components to said left adder circuit and said right channel input line communicates with a right branch line having a low pass filter for adding low frequency signal power to said right adder circuit.

9. The invention as defined in claim 1 and further comprising at least one gain control for limiting each of the said signals added at said left channel and right channel outputs to obtain a flat response over the audio signal frequency range.

10. The invention as defined in claim 9 and further comprising a first gain controller in each said crossfeed line and a second gain controller in each said input line.

11. An apparatus for transmitting stereophonic signal to at least a pair of loudspeakers comprising:

a left channel input line;

a right channel input line;.

a left branch line coupled to said left channel input line and including a left low pass filter;

a right branch line coupled to said right channel input line and including a right low pass filter;

a left direct line coupled to said left channel input line and added to the output from said left low pass filter;

a right direct line coupled to said right channel input line and added to the output of said right low pass filter;

a left-to-right crossfeed path coupled to said left channel input line and added to said right direct line including a left high pass filter and first means for delaying the signal in said left-to-right crossfeed path to provide fluctuated frequency weighted coherence from the loudspeakers;

a right-to-left crossfeed path coupled to said right channel input line and added to said left direct line, including a right high pass filter and second means for delaying the signal in said right-to-left crossfeed path to provide fluctuated frequency weighted coherence from the loudspeakers;

whereby said loudspeakers emit sound signals simulating a narrower perceived audible distance between said loudspeakers than the physical distance between said speakers.

12. The invention as defined in claim 11 wherein each said first and second means for delaying the signal comprises a means for delaying the signal independent of frequency.

13. In a stereo audio reproduction system having at least one pair of two speakers physically spaced apart for separated left channel output signal and right channel output signal, and having a left channel input signal and a right channel input signal, the improvement comprising:

means for delivering one of the left channel output signal and the right channel output signal to one of said speakers of a pair and delivering the other of the left channel output signal and the right channel output signal to another speaker of said pair; and means for narrowing the psycho-acoustically perceived distance between said pair of speakers by crossfeeding a frequency weighted, delayed, non-inverted portion of said right channel input signal as part of said left channel output signal and crossfeeding a frequency weighted, delayed, non-inverted portion of said left channel input signal as part of said right channel output signal to obtain a fluctuated frequency weighted coherence from said pair of speakers.

14. An apparatus for processing stereo imaging of stereophonic signals to be delivered to at least one pair of loudspeakers comprising:

a left channel output line coupled to a first speaker of said at least one pair;

a right channel output line coupled to a second speaker of said at least one pair;

a left channel input line;

a right channel input line;

a left-to-right crossfeed path initiating at said left channel input line, a right adder for adding said left-to-right crossfeed path to said right input line at said right channel output line;

a right-to-left crossfeed path initiating at said right channel input line;

a left adder for adding said right-to-left crossfeed path to said left channel input line at said left channel output line;

each of said crossfeed paths having a transfer function circuit for repeatedly fluctuating the phase of the respective input signal passing through the crossfeed path to vary the channel coherence of the sound signal emitted from said at least one pair of loudspeakers; and wherein each said channel input line includes a shelving filter transfer function for boosting the power output of low frequency signal components.

15. The invention as defined in claim 14 wherein said shelving filter comprises a branch line communicating with said channel input line, having a low pass filter and adding to said channel input line and the respective crossfeed path.

16. The invention as defined in claim 15 wherein said low pass filter introduces a signal delay in said branch line wherein the duration of said signal delay varies with frequency, and wherein said channel input line includes an all pass filter with a time delay response corresponding to said signal delay for correcting the shelving filter response.

17. The invention as defined in claim 15 wherein said low pass filter introduces a signal delay in said branch line wherein the duration of said signal delay varies with frequency, and wherein said branch line also includes an all-pass filter to equalize the phase of the branch signals to obtain a frequency independent delay in the branch line, and further comprising a frequency independent delay in said channel input line downstream of branch line to delay the channel input signal an amount corresponding to the delay in said branch line.

18. The invention as defined in claim 15 wherein said low pass filter introduces a signal delay in said branch line wherein the duration of said signal delay varies with frequency, and further comprising a signal delay circuit in said channel input line for imposing a constant delay on the direct input signal.

19. The invention as defined in claim 18 and further comprising a signal delay circuit in each crossfeed path that is added to said channel input lines at said channel output line to coordinate the phases of the signals added at said channel output lines.

20. An apparatus for processing stereo imaging of stereophonic signals to be delivered to at least one pair of loudspeakers comprising:

a left channel output line coupled to a first speaker of said at least one pair;

a right channel output line coupled to a second speaker of said at least one pair;

a left channel input line;

a right channel input line;

a left-to-right crossfeed path initiating at said left channel input line, a right adder for adding said left-to-right crossfeed path to said right input line at said right channel output line;

a right-to-left crossfeed path initiating at said right channel input line;

a left adder for adding said right-to-left crossfeed path to said left channel input line at said left channel output line;

each of said crossfeed paths having a transfer function circuit for repeatedly fluctuating the phase of the respective input signal passing through the crossfeed path to vary the channel coherence of the sound signal emitted from said at least one pair of loudspeakers;

a gain control for limiting the maximum output at said left channel output line and said right channel output line; and wherein said gain control comprises a stereo detector for controlling the crossfeed gain applied to the signals added at said channel output line.

21. An apparatus for processing stereo imaging of stereophonic signals to be delivered to at least one pair of loudspeakers comprising:

a left channel output line coupled to a first speaker of said at least one pair;

a right channel output line coupled to a second speaker of said at least one pair;

a left channel input line;

a right channel input line;

a left-to-right crossfeed path initiating at said left channel input line, a right adder for adding said left-to-right crossfeed path to said right input line at said right channel output line;

a right-to-left crossfeed path initiating at said right channel input line;

a left adder for adding said right-to-left crossfeed path to said left channel input line at said left channel output line;

each of said crossfeed paths having a transfer function circuit for repeatedly fluctuating the phase of the respective input signal passing through the crossfeed path to vary the channel coherence of the sound signal emitted from said at least one pair of loudspeakers; and a gain control for limiting the maximum output at said left channel output line and said right channel output line;

wherein said gain control includes means for automatically adjusting the gain in response to the level of stereo separation between said left and right channel input lines.

22. The invention as defined in claim 21 wherein said means for automatically adjusting the gain includes means for proportionally adjusting the gain over at least one predetermined range of stereo separation.

23. An apparatus for processing stereo imaging of stereophonic signals to be delivered to at least one pair of loudspeakers comprising:

a left channel output line coupled to a first speaker of said at least one pair;

a right channel output line coupled to a second speaker of said at least one pair;

a left channel input line;

a right channel input line;

a left-to-right crossfeed path initiating at said left channel input line, a right adder for adding said left-to-right crossfeed path to said right input line at said right channel output line;

a right-to-left crossfeed path initiating at said right channel input line;

a left adder for adding said right-to-left crossfeed path to said left channel input line at said left channel output line;

each of said crossfeed paths having a transfer function circuit for repeatedly fluctuating the phase of the respective input signal passing through the crossfeed path to vary the channel coherence of the sound signal emitted from said at least one pair of loudspeakers;

a gain control for limiting the maximum output at said left channel output line and said right channel output line; and wherein said gain control includes means for manually adjusting the gain of said signals added at said channel outputs.

24. An apparatus for processing stereo imaging of stereophonic signals to be delivered to at least one pair of loudspeakers comprising:

a left channel output line coupled to a first speaker of said at least one pair;

a right channel output line coupled to a second speaker of said at least one pair;

a left channel input line;

a right channel input line;

a left-to-right crossfeed path initiating at said left channel input line, a right adder for adding said left-to-right crossfeed path to said right input line at said right channel output line;

a right-to-left crossfeed path initiating at said right channel input line;

a left adder for adding said right-to-left crossfeed path to said left channel input line at said left channel output line;

each of said crossfeed paths having a transfer function circuit for repeatedly fluctuating the phase of the respective input signal passing through the crossfeed path to vary the channel coherence of the sound signal emitted from said at least one pair of loudspeakers; and wherein each said left channel input line communicates with a left branch line having a low pass filter for adding low frequency components to said left adder circuit and said right channel input line communicates with a right branch line having a low pass filter for adding low frequency signal power to said right adder circuit.

25. The invention as defined in claim 24 and further comprising at least one gain control for limiting each of the said signals added at said left channel and right channel outputs.

26. The invention as defined in claim 25 wherein said gain control includes means for automatically adjusting the gain in response to the level of stereo separation between said left and right channel input lines.

27. The invention as defined in claim 26 wherein said gain control includes means for adjusting crossfeed gain in each crossfeed path.

28. The invention as defined in claim 27 wherein each of said left and right input lines include means for adjusting the gain of the input signal added at said respective adder in correspondence with $$\sqrt{1 - G^2}$$

where G is the crossfeed gain in the crossfeed path.

29. The invention as defined in claim 28 wherein each said left and right branch line includes means for adjusting the gain of the branch line signal added at said respective adder in correspondence with $$1 - \sqrt{1 - G^2}$$

where G is the crossfeed gain in the crossfeed path.

* * * * *